US007288745B2

(12) United States Patent
Colonna

(10) Patent No.: US 7,288,745 B2
(45) Date of Patent: Oct. 30, 2007

(54) TEMPERATURE CONTROLLED FOOD STORAGE AND SERVING PAN

(76) Inventor: Frank Colonna, 203 Glendora Ave., Suite A, Long Beach, CA (US) 90803

( * ) Notice: Subject to any disclaimer, the term of this patent is extended or adjusted under 35 U.S.C. 154(b) by 0 days.

(21) Appl. No.: 10/976,432

(22) Filed: Oct. 29, 2004

(65) Prior Publication Data

US 2006/0091129 A1 May 4, 2006

(51) Int. Cl.
*A47J 36/24* (2006.01)
*A47F 3/04* (2006.01)
*F25D 3/06* (2006.01)

(52) U.S. Cl. ..... 219/439; 219/438; 62/257; 62/457.6; 220/573.4; 220/554; 222/146.2; 222/146.5; 222/146.6

(58) Field of Classification Search ..... 220/573.4, 220/554
See application file for complete search history.

(56) References Cited

U.S. PATENT DOCUMENTS

| | | | | | |
|---|---|---|---|---|---|
| 400,255 | A | * | 3/1889 | Schuckman | 99/411 |
| 434,688 | A | * | 8/1890 | Veley | 220/573.4 |
| 1,299,267 | A | * | 4/1919 | Tiers | 220/573.4 |
| 1,344,326 | A | * | 6/1920 | Williams | 126/20 |
| 1,768,976 | A | | 7/1930 | Cuthbertson | |
| 1,881,873 | A | * | 10/1932 | Newcomb | 220/574.2 |
| 2,817,744 | A | * | 12/1957 | Free | 219/439 |
| 3,130,288 | A | * | 4/1964 | Monaco et al. | 219/385 |
| 3,703,088 | A | * | 11/1972 | Moorhead | 62/430 |
| 3,859,505 | A | * | 1/1975 | Herbrand et al. | 219/433 |
| 4,013,869 | A | * | 3/1977 | Orts | 219/401 |
| 4,106,486 | A | * | 8/1978 | Lee | 126/369 |
| 4,509,412 | A | * | 4/1985 | Whittenburg et al. | 99/331 |
| 4,520,633 | A | * | 6/1985 | Hoydic | 62/457.6 |
| 4,832,226 | A | * | 5/1989 | Leon | 99/403 |
| 4,889,972 | A | * | 12/1989 | Chang | 219/438 |
| 4,897,525 | A | * | 1/1990 | Hirsch | 219/401 |
| 4,982,656 | A | * | 1/1991 | Stone | 99/403 |
| 5,065,889 | A | * | 11/1991 | Conti | 220/360 |
| 5,307,647 | A | | 5/1994 | McClure | |
| 5,381,729 | A | * | 1/1995 | Hennessy et al. | 99/483 |
| 5,701,757 | A | | 12/1997 | Heverly | |
| 5,704,485 | A | | 1/1998 | Cautereels et al. | |
| 5,799,866 | A | * | 9/1998 | Hattem | 220/574 |
| 5,921,423 | A | * | 7/1999 | Howell et al. | 220/23.86 |
| 6,018,145 | A | * | 1/2000 | Moreno | 219/401 |
| D444,058 | S | | 6/2001 | Hampshire et al. | |
| 6,311,841 | B1 | | 11/2001 | Hodges | |
| 6,378,325 | B1 | | 4/2002 | Yang | |
| 6,593,552 | B1 | * | 7/2003 | Li | 219/432 |
| 6,674,050 | B2 | * | 1/2004 | Hansen | 219/439 |
| 6,763,959 | B2 | | 7/2004 | Tedder | |
| 6,774,343 | B2 | * | 8/2004 | Ibanez | 219/386 |
| 2002/0060216 | A1 | * | 5/2002 | Chan | 219/430 |

* cited by examiner

*Primary Examiner*—J. Pelham
(74) *Attorney, Agent, or Firm*—Fulwider Patton LLP

(57) ABSTRACT

A pan including a shelf dividing the interior thereof into a lower chilling element and an upper portion disposed in heat relationship with the lower portion and a lid for covering the top of the container and having a serving surface for display of food thereon.

15 Claims, 4 Drawing Sheets

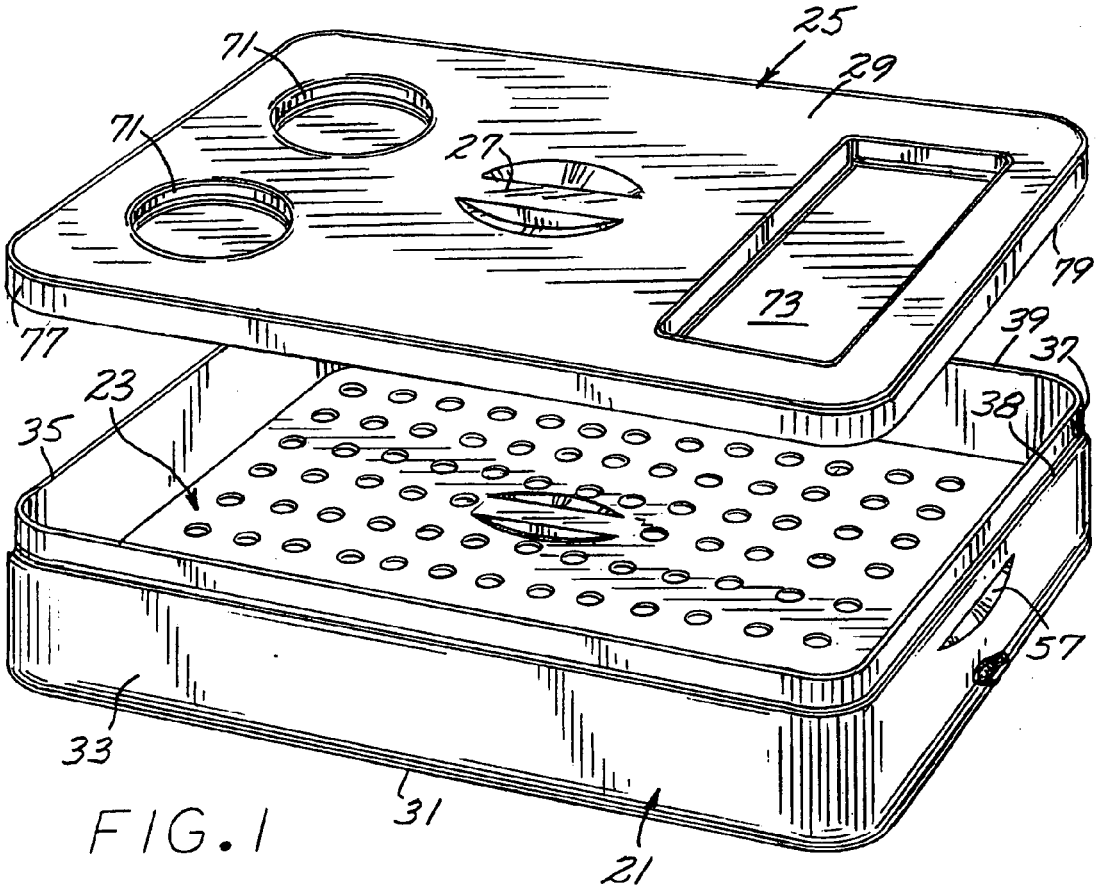
FIG. 1
FIG. 2
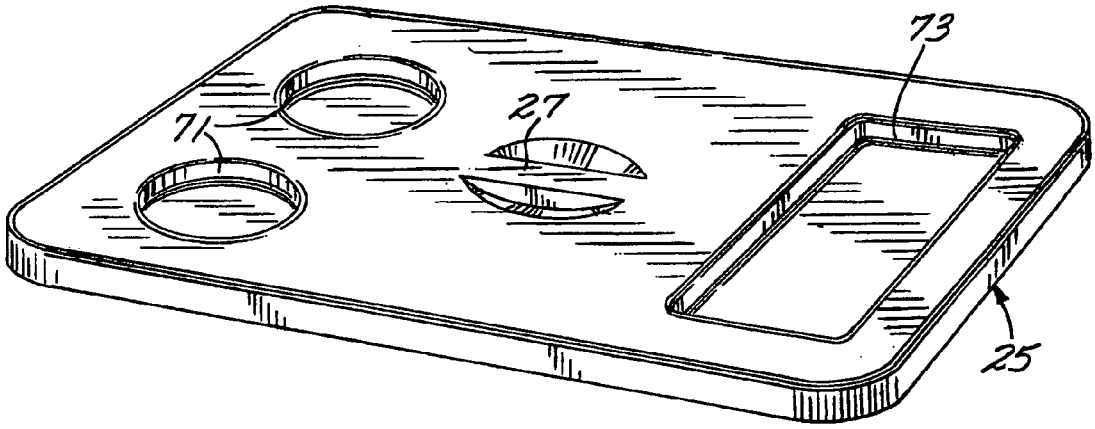

TEMPERATURE CONTROLLED FOOD STORAGE AND SERVING PAN

FIELD OF THE INVENTION

The present invention relates generally to food storage devices and more particularly to temperature controlled containers which may store food and be utilized to present the food for viewing and consumption.

DESCRIPTION OF THE PRIOR ART

In the retreat from the busy workday life, diversion is often sought in the way of relaxation and the quality enjoyment enhanced by the presentation of hors d'oeuvres or other foodstuff. This has led to the development of numerous different styles of so-called "coolers" which may be described as a large insulated container for receiving beverages and foodstuff to be chilled by ice or gel packs of the like.

Other efforts have led to the development of plastic storage containers, sometimes compartmentalized so that the foodstuff can be conveniently prepared in advanced and stored in the refrigerator ready for consumption.

In many instances, the participant responsible for preparation and serving of the foodstuff is left with several steps to be performed at the time of serving and is faced with the challenge of endeavoring to time service such that the temperature of the foodstuff does not materially deviate from the optimum service temperature thus requiring some degree of skill at predicting the time guests might want to be served hors d'oeuvres or the like and the period over which the fruit stuffs will be consumed.

Over the years, many efforts have been made to solve the problem of storing and controlling the temperature of the prepared foodstuffs and the selection of a serving tray which can be maintained at the desired serving temperature and which is readily available for convenient service of the foodstuff.

Various aspects of these challenges have been dressed by various devices previously developed. In recognition of the need for controlling the temperature of different foodstuffs, it has been proposed to construct a hors d'oeuvres tray with a series of divided and separable food compartments over a heat sink. A device of this type is shown in U.S. Pat. No. 1,768,976 to Cuthbertson.

It also has been proposed to convert a traditional cooler to employ a series of stacked shelves which might hold different foodstuffs. A device of this type is shown in U.S. Pat. No. 6,763,959 to Tedder.

Stackable food trays have also been proposed for stacking various foodstuffs in preparation for serving large groups such as weddings, parties and institutional environments. It has been proposed to provide a plurality of nesting bowls which would cooperate to form spaces for receipt of water or the like which can be chilled or frozen and to be maintained in heat exchange relationship with foodstuff in one of the bowls such that the temperature of such foodstuff might be controlled.

Other efforts to address the problem have led to the proposal of portable open-topped receptacles having double bottoms and hinged covers. The double bottom would define a space for receiving a temperature-maintaining fluid such as a bath of water. A plurality of concave shelves would be spaced over the fluid.

Another proposed thermal enclosure is described as being made up of a container having a removable cover in combination with a double wall arrangement for flow of fluid in heat exchange relationship there through.

Further efforts to solve the temperature control problem led to the development of a device incorporating a lower and upper pan which may nest together to form a lower compartment for receipt of a gel pack or the like. The upper pan can receive foodstuffs and a hat shaped cover may be placed over to cover the food. A device of this patent is shown in U.S. Pat. No. 5,307,647 to McClure.

Other efforts to develop satisfactory temperature controlled food container have led to the proposal of a device including a lower pan and a shelf for nesting therein to receive thereover a gel pack which may be utilized to cool food stored there below. A device of this type is shown in U.S. Pat. No. 5,704,485 to Cautereels.

Other arrangements for maintaining the temperature for maintaining the temperature of foodstuffs include the nesting of one container within another to form a space therebetween for receipt of a gel pack and wherein the two containers are sealingly connected together and covered by a thermal lid. A device of that type is shown in U.S. Pat. No. 5,701,757 to Heverly.

Further efforts have led to the proposal of a salad bowl having upper and lower compartments for receipt of ice or the like to cool salad received in a space formed between the two ice compartments. A device of this type is shown in U.S. Pat. No. 6,378,325 to Yang.

While each of the above-referenced devices have certain utility, there remains a need for a device which is convenient and compact for storage of food and which can be easily received in a refrigerator or the like and will itself house a thermal element to maintain temperature control and which incorporates a serving tray typically stored and thermal exchange relationship with the thermal element so that it is maintained in the same temperature range as the foodstuff and ready to act as a serving tray.

SUMMARY OF THE INVENTION

The present invention is characterized by the container for receipt of a thermally active element for emitting or absorbing heat and incorporating a shelf for supporting food and heat exchange relationship therewith, as well as a lid also disposed in heat exchange relationship with the compartment and having a handle or handles and having a service surface for display of food thereon and a handle or handles for grasping to serve food retrieved from the shelf.

Other features and advantages of the invention will become apparent from the following detailed description, taken in conjunction with the accompanying drawings which illustrate, by way of example, the features of the invention.

BRIEF DESCRIPTION OF THE DRAWINGS

FIG. 1 is a perspective view of a food storage and serving pan embodying the present invention;

FIG. 2 is a top view of the tray incorporated in the pan shown in FIG. 1;

DETAILED DESCRIPTION OF THE INVENTION

Figure 3:
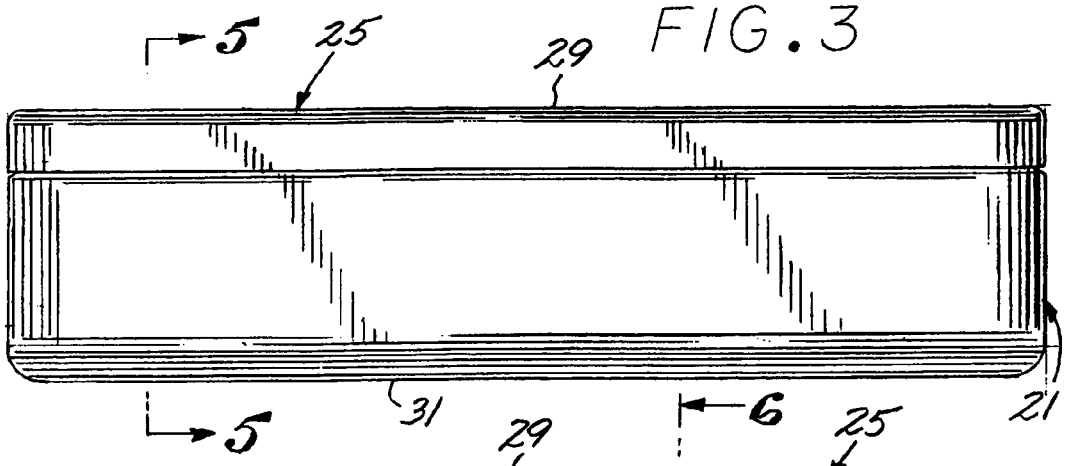
FIG. 3 is a front view of the pan shown in FIG. 1.

Referring to FIGS. 1-5, the temperature controlled food storage and serving pan of the present invention includes, generally, a container 21 receiving a thermally conductive shelf 23 and covered by a lid 25 which includes a handle 27 and an upwardly facing service surface. The shelf 23 may have ice or other thermally active material located there under to chill foodstuff disposed thereon ready for serving so that the lid 25 may be removed and foodstuff placed on the upper service surface 29 so the lid can act as a tray to serve the food at a temperature dictated by the thermal element.

The device of the present invention may be made of any desirable material such as synthetic resin material or metal or other material well known in the art. The pan is preferably low profile having a height of about 6½ inches and preferably an overall height of no more than 8 inches so that the thermal element, such as ice or the like will be spread out over a relatively large area disposed on the shelf 23 in close spaced relationship with the ice or the like to thus provide for a relatively uniform temperature.

The container 21 is generally rectangular in shape, formed with rounded corners and includes a bottom wall 31 and upstanding sidewalls 33 and end walls 35. The peripheral walls terminate in an upwardly opening formed in the upper extent with a peripheral recess 37 which opens outwardly and upwardly and terminates at the lower extremity in a peripheral upwardly facing shoulder 38. The walls terminate at their upper extremity in an edge which might be deemed a lip 39.

Figure 5:
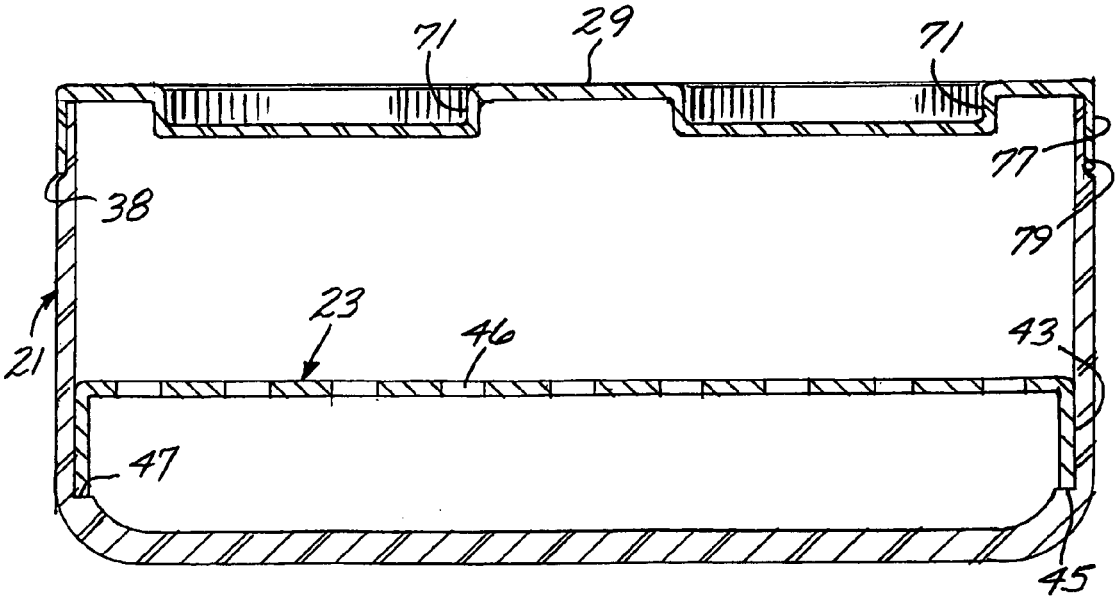
FIG. 5 is a transverse sectional view in enlarged scale, taken to the line 5-5 of FIG. 3.

Referring to FIG. 5, the shelf 23 may be formed at its periphery with a downwardly extending parametrical skirt 43 which interfits in close spaced relationship within the confines of the peripheral walls 33 and 35 and terminates in a lower edge 45. The peripheral walls are conveniently formed for receipt of the periphery of the wall 43 in close spaced relationship and are configured in their lower extent with a upwardly facing shoulder 47 upon which the lower edge 45. On the shoulder 45 to maintain the plate defined by the shelf 23 spaced approximately 2 inches above the bottom wall of the container to define a space for receipt of a heater or heat sink such as ice, or cooling gel or a chemical packet for emitting or absorbing energy to control the temperature of the food. In the preferred embodiment, the shelf 23 is perforated with circular bores 46 spaced throughout for inducing rapid conduction of heat to or from the foodstuff.

Referring to FIG. 1, the shelf is formed centrally with a pair of upwardly opening crescent shaped depressions 51 and 53 to define hand holds into which the tips of a user's fingers might be entered to grip the shelf for removal thereof.

Figure 4:
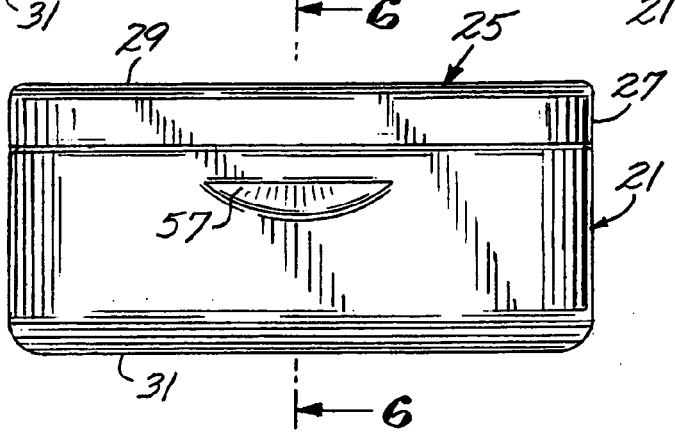
FIG. 4 is a left hand view of the pan shown in FIG. 1.

Referring to FIGS. 1 and 4 the end walls of the container are formed with inwardly recessed hand grips 57 which may also be grasped by the finger tips of the user to facilitate lifting and movement of the pan.

Figure 6:
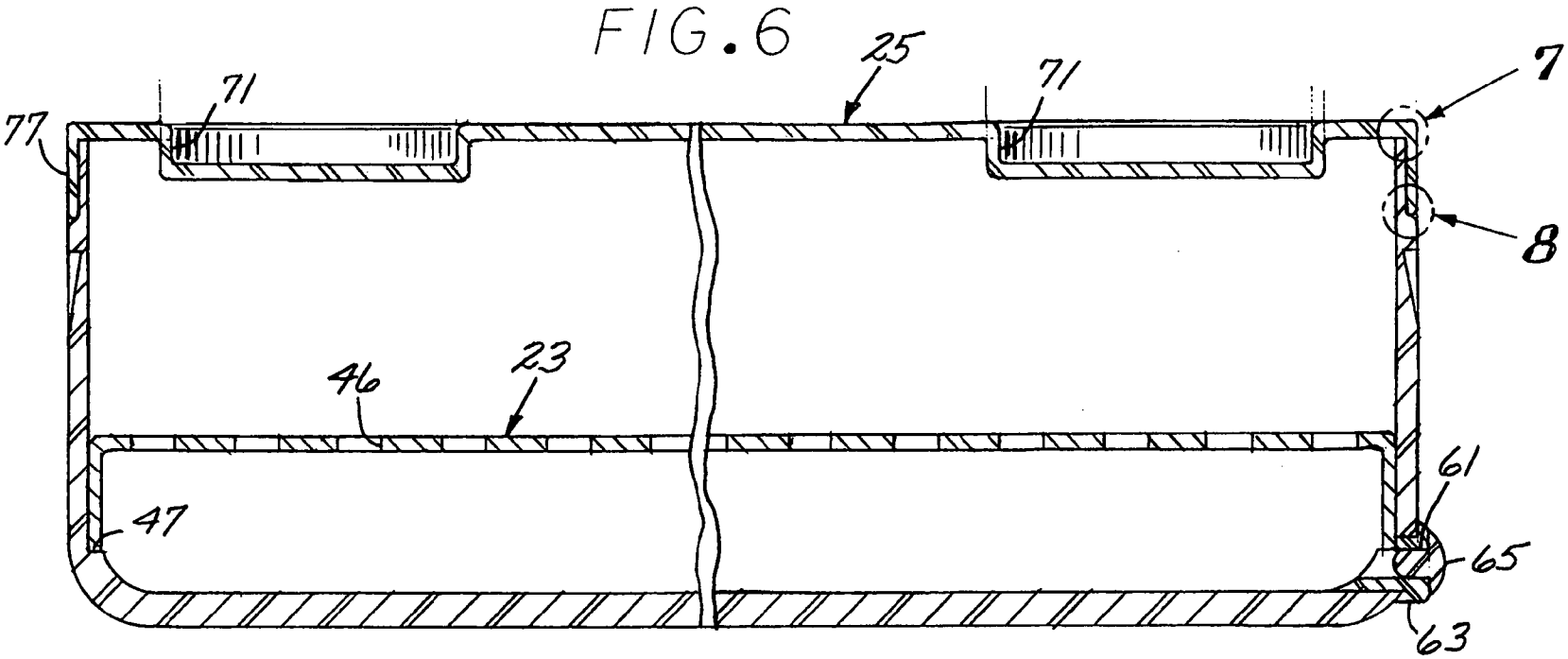
FIG. 6 is a longitudinal sectional view of the end shown in FIG. 1 but in enlarged scale.

Referring to FIG. 6, one of the end walls of the container may be formed near the bottom extremities thereof with a drain bore 61 which receives a grommet 63 normally plugged by a resilient plug 65 but removable for draining of moisture or water from the container itself.

Referring to FIGS. 1 and 2, the lid 25 may conveniently be formed in its upper surface with respective circular and rectangular depressions 71 and 73 which might conveniently serve for receipt of food to be served. It will be appreciated by those skilled in the art, this is an optional feature and is not a critical part of the present invention.

Figure 8:
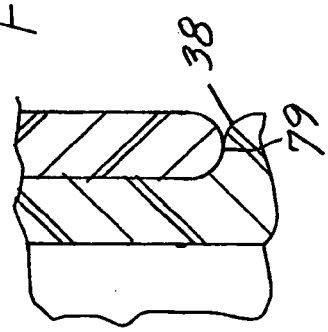
FIG. 8 is a detailed sectional view, in enlarge scale, taken from the circle 8 in FIG. 6.
Figure 7:
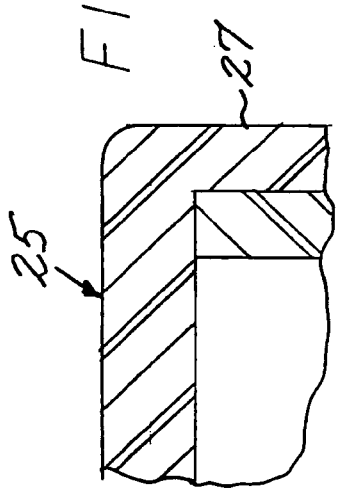
FIG. 7 is a detailed sectional view, in enlarged scale, taken from the circle 7 in FIG. 6.

Referring to FIGS. 1 and 6, the lid 25 is formed about the periphery thereof with a down turn depending skirt 77 which is configured to fit in close fit sliding relationship with the depression 37 in the peripheral walls of the container and to press downwardly thereon with the lower edge 79 thereof abutting the upwardly facing shoulder 38 (FIG. 8). The lid and container, in some instances, are constructed of thermally insulated material.

It will be appreciated that preparation for a gathering, a number of pans of the present invention may be utilized to store and maintain the temperature of different foodstuffs, whether hot or cold. A convenient size for the pan is with a container of about 13½ inches wide and 24 inches long. The peripheral walls 33 and 35 of the container may be about 6½ inches high. The lid 25 may be formed with the peripheral skirt having a vertical dimension of about 1½ inches to complementally fit within the depression 37.

The handle 27 on such tray may take many different forms, such as a bail type, hinged wire, knob or rail.

In use, the pan may conveniently be used in advance when the foodstuff is being prepared for storage. It will be appreciated that the handle 27 of the lid may be grasped and the lid removed from container 21. The slots 51 and 53 may be gripped by the user to manipulate the shelf from the container 21 such that for food to be cooled, ice, cooling gel or the like may be placed there under and on the top of the bottom wall of such container. The shelf 23 may be positioned back in place as shown in FIG. 6. Foodstuff may then be placed on the shelf and distributed thereabout for ready communication of heat to be drawn there from by the ice or cooling gel. The lid 25 may then be positioned on the container with the skirt forming a slip fit seal with the depression 37 and the pan stored in the refrigerator or other convenient location until it is time to serve.

When the host or hostess is ready to serve the guests, the pan may be removed from the refrigerator by grasping the handles 57 to move the pan to the gathering location. The handle 27 of the tray 25 may then be grasped and the tray removed from the container and foodstuff taken from the food compartment to be placed on the service surface 29 and if desirable, within the depressions 71 and 73 and the tray passed about so that guests may take portions of such foodstuff there from for their personal consumption.

During the time, guests are enjoying the foodstuffs, that portion remaining on the shelf 23 the temperature of that remaining on the shelf 23 will be controlled by the ice, cooling gel or chemical pack located under the shelf ready for replenishment as that on the serving surface 29 is depleted.

Figure 9:
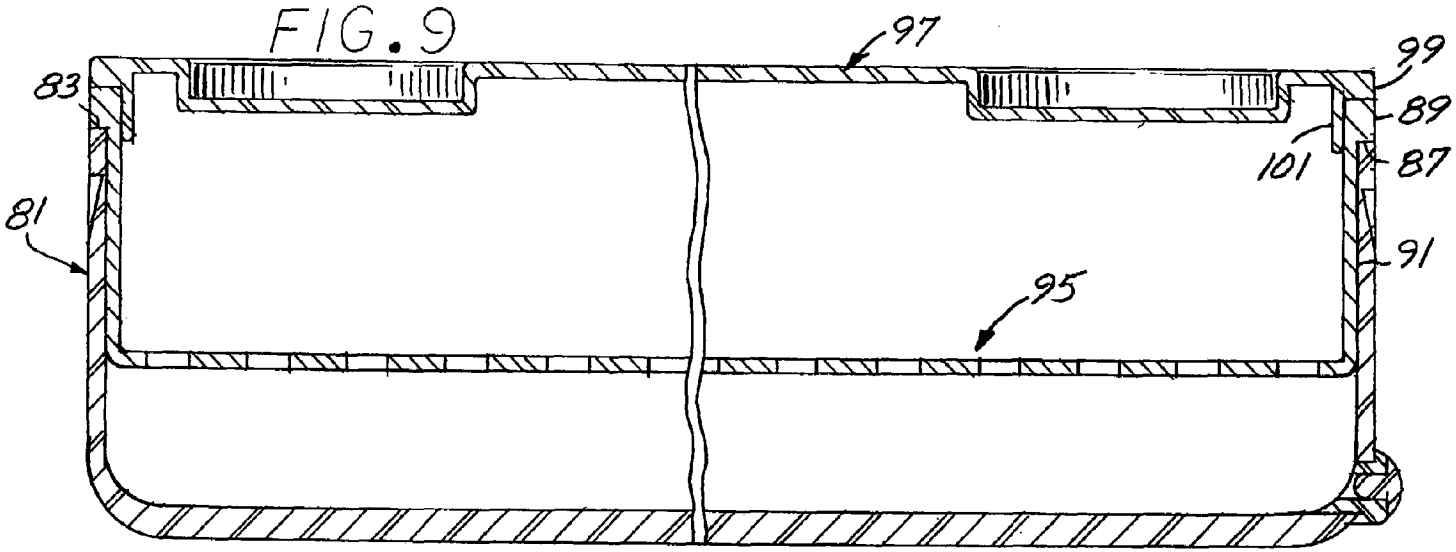
FIG. 9 is a broken longitudinal sectional view of a second embodiment of the pan of the present invention.

The second embodiment of the pan of the present invention shown in FIG. 9 is similar to that shown in FIGS. 1-8 except that the peripheral walls of the container 81 terminate in an upwardly facing upper edge 83 unto which a downwardly facing shoulder 87 of a rim 89 formed in the upper portion of an upstanding peripheral wall 91 of the shelf, generally designated 95. In this manner, the peripheral shelf wall 91 may be telescoped downwardly into the confines of the peripheral wall of the container and the positioning rib 89 will serve to maintain the surface of such shelf 95 at the desired height to form the cooling compartment there below on the food compartment there above.

In this configuration, the tray, generally designated 97, is formed about its periphery with a peripheral rib 99 nested on the rim 89 and a downwardly depending inwardly spaced stub wall 101, telescoped downwardly into the interior of the peripheral shelf wall 91.

Figure 10:
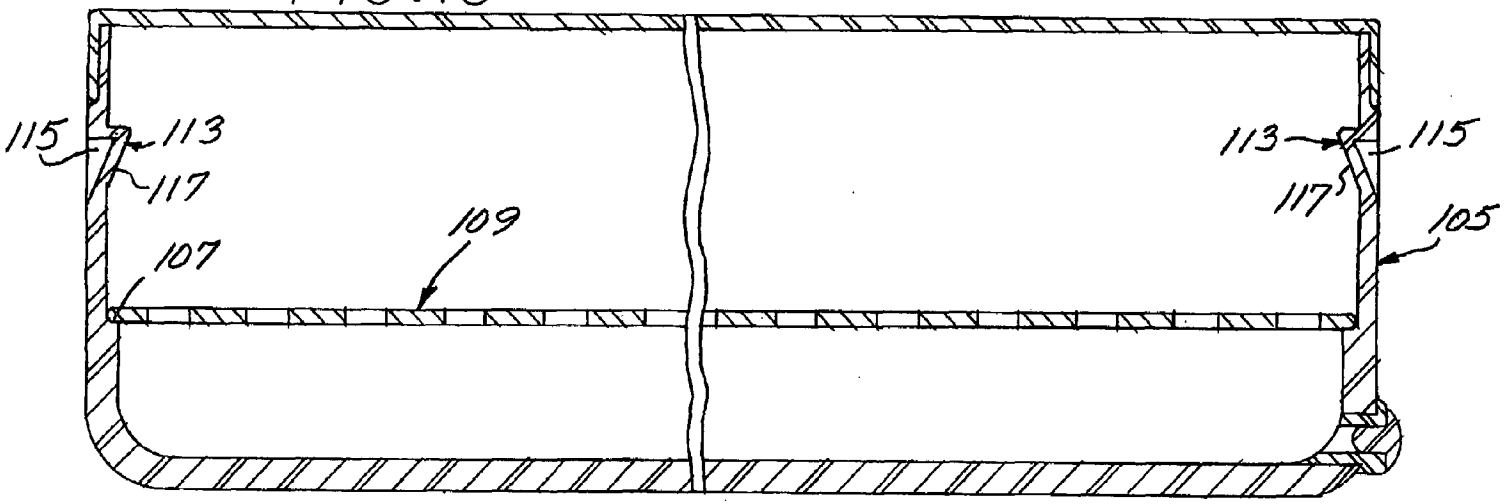
FIG. 10 is a broken longitudinal sectional view of a third embodiment of the pan of the present invention.

The third embodiment of the pan of the present invention shown in FIG. 10 is also similar to that shown in FIGS. 1-8 except here, the interior surface of the peripheral walls of the container, generally designated 105, is formed in internally with a peripheral upwardly facing shoulder 107 onto which a planar shelf generally designated 109 nests to maintain that shelf at the desired spaced relationship above the bottom wall. The end walls are molded in their upper portions with centrally located angular inwardly projecting teeth 113 which form at the other extent respective recesses 115 acting as finger grips and which form on the interior upwardly and inwardly inclined cam surfaces 117. The shelf 109 may be constructed of a length such that one end thereof can be pivoted upwardly from the support shoulder 107 to clear the respective cam surfaces 117 or, in some instances, the shelf will be flexible so as to allow for bowing thereof centrally upwardly to clear the cam surfaces 117 for removal thereof to replace gel packs ice or the like there under.

From the foregoing, it will be clear that the low profile food storage and temperature control pan of the present invention is economical to manufacture and will provide a convenient means for storing prepared food at the desired temperature and to present that food for serving and also providing a tray for service thereof in an attractive and convenient manner.

I claim:

1. A low profile food temperature control and serving pan and storage device comprising:

a container having a bottom wall and upwardly projecting peripheral walls defining a thermal compartment for receiving a heat element and terminating upwardly in a peripheral lip;

the walls being formed on opposite sides with molded inwardly projecting hand grips defining on the interior thereof respective catches disposed at a predetermined level and spaced a predetermined distance from one another;

a shelf configured to be removably received in the compartment to be positioned at a selected level spaced above the bottom wall and below the predetermined level to divide the thermal compartment into a heat element cavity disposed there below and a food storage compartment disposed there above and configured to conduct heat therethrough, the shelf being longer than the predetermined distance;

a shelf support device in the container and having an upwardly facing support shoulder disposed to support the shelf at the selected level; and a service lid defining upper and lower surfaces and configured with a marginal edge to nest against the lip, one of the surfaces defining a service surface.

2. The low profile pan of claim 1 wherein:

the service surface is formed with indentations defining cavities for receiving foods.

3. A low profile pan of claim 1 wherein:

the lid is configured to nest against the lip with the upper surface facing upwardly and includes a handle on the upper surface, the upper surface being arrayed about the handle.

4. The low profile pan of claim 1 wherein:

the lid is formed with the upper surface defining the service surface and includes a handle formed in the upper surface.

5. The low profile pan of claim 1 wherein:

the lid is configured with the handle formed centrally in the upper surface.

6. The low profile pan of claim 1 wherein:

the container rectangular shaped in horizontal cross section;

the lid is rectangular shaped in horizontal cross section and is formed with its upper surface planar and configured with downwardly recessed food receiving cavities.

7. A low profile food temperature control and serving pan and storage device comprising:

a rectangular in horizontal cross section container having a bottom and upwardly projecting peripheral walls defining a thermal compartment for receiving a heat element and terminating upwardly in a peripheral lip;

a shelf formed about its periphery with downwardly turned perimetrical walls and configured to be removably received in the compartment to be positioned at a selected level supported spaced above the bottom wall to divide the thermal compartment into a heat element cavity disposed there below and a food storage compartment disposed there above and configured to conduct heat therethrough;

the peripheral walls configured to form a shelf support device having oppositely disposed walls including inwardly projecting tabs defining upwardly facing support shoulders disposed to support the shelf at the selected level; and a rectangular service lid configured with a marginal edge to nest against the lip and formed with an upper surface recessed downwardly to form food-receiving cavities and the lid including a handle to be grasped to hold the lid with the upper surface facing upwardly to display food thereon.

8. The low profile pan of claim 7 wherein:

the shelf is formed with perforations.

9. The low profile food temperature control storage and serving device of claim 7 wherein:

the lid is configured with the handle formed centrally in the upper surface.

10. The low profile food temperature control and serving pan of claim 7 to serve as a cooler pan and wherein:

at least one of the peripheral or bottom walls are formed with a drain hole.

11. The pan of claim 7 wherein: the lid is formed with a downwardly depending perimetrical skirt.

12. The low profile pan of claim 7 wherein: the shelf includes a handle.

13. The low profile pan of claim 7 wherein: the peripheral wall is substantially 10 inches high.

14. The low profile pan of claim 7 wherein: the peripheral wall is no more than 6 ½ inches high.

15. A low profile food temperature control and serving pan and storage device comprising:

a container having a bottom wall and upwardly projecting peripheral walls defining a thermal compartment for receiving a heat element and terminating upwardly in a peripheral lip, the peripheral walls are formed exteriorly about their periphery adjacent the lip with an outwardly opening indention;

a shelf configured to be removably received in the compartment to be positioned at a selected level supported spaced above the bottom wall to divide the thermal compartment into a heat element cavity disposed there below and a food storage compartment disposed there above;

the peripheral end wails of the container are formed with molded inwardly projecting band grips defining on the interior thereof a catch for restricting the shelf against removal from the container;

a shelf support device in the container and having upwardly facing support shoulders disposed to support the shelf at the selected level;

the shelf being formed with a downwardly depending perimetrical skirt configured to be received in the shoulders; and a service lid defining upper and lower surfaces and configured with a marginal edge to nest against the lip and in the indention, one of the surfaces defining a service surface.

* * * * *